United States Patent [19]

Vogel et al.

[11] Patent Number: 5,067,472

[45] Date of Patent: Nov. 26, 1991

[54] BOW STRING RELEASE

[76] Inventors: Michael A. Vogel, 7875 Hollywood Dr.; Martin D. Sears, 3901 Harwich, both of Jackson, Mich. 49203

[21] Appl. No.: 558,227

[22] Filed: Jul. 26, 1990

[51] Int. Cl.[5] ..... F41B 5/00

[52] U.S. Cl. ..... 124/35.2; 124/40

[58] Field of Search ..... 124/25.6, 35.1, 35.2, 124/86, 90

[56] References Cited

U.S. PATENT DOCUMENTS

| | | | |
|---|---|---|---|
| 440,538 | 11/1890 | Bruton | 124/35.1 X |
| 1,542,159 | 6/1925 | Maxwell | 124/35.2 |
| 2,488,597 | 11/1949 | Konold | 124/35.2 |
| 2,819,707 | 1/1958 | Kayfes et al. | 124/35.2 |
| 3,948,243 | 4/1976 | Gazzara, Sr. | 124/35.2 |
| 4,036,204 | 7/1977 | Scott | 124/35.2 |
| 4,257,386 | 3/1981 | Gazzara | 124/35.2 |
| 4,282,851 | 8/1981 | Lyons | 124/35.2 |
| 4,407,260 | 10/1983 | Lyons | 124/35.2 |
| 4,527,536 | 7/1985 | Smith | 124/35.2 |
| 4,881,516 | 11/1989 | Peck | 124/35.2 |

*Primary Examiner*—Peter M. Cuomo
*Assistant Examiner*—Jeffrey L. Thompson
*Attorney, Agent, or Firm*—Beaman & Beaman

[57] ABSTRACT

A bow string release characterized by its ability to easily release the bow string and arrow smoothly and without deviation to improve accuracy. A body universally swivelly affixed to a wrist strap includes pivoted string retainers controlled by a pair of retainer operators through a toggle lever mechanism. The operators include handle portions extending from the lateral sides of the body wherein the release may be operated by a pinch or squeeze movement of the fingers, pivoted levers having pivots approaching an "on center" relationship permit high string pressure to be easily released and a safety mechanism prevents premature string release during the draw.

13 Claims, 2 Drawing Sheets

BOW STRING RELEASE

BACKGROUND OF THE INVENTION

In the sport of archery the bow string is drawn to tension the bow, and in its elementary manner the bow string is grasped by the ends of the fingers during drawing. As release of the bow string by the fingers may produce string deviation during release, and also imposes high stress upon the fingers, string and arrow release devices are commonly used to aid in the drawing of the string and releasing the string and arrow to alleviate the problems attendant with finger operation.

A wide variety of bow string release devices are known, and typical examples are shown in U.S. Pat. No. 1,542,159; 3,948,243; 4,036,204; 4,282,851; 4,407,260 and 4,881,516. The bow string and arrow release devices shown in the aforementioned patents include pivoted retainers for the string or arrow, toggle and clamp actuators, triggers, cams, and a variety of mechanical motions to achieve the desired result. However, bow string releases presently available do not achieve the ease and smoothness of action and lack of deviation during release to achieve utmost accuracy, and it is a purpose of the invention to overcome these deficiencies of prior art devices and provide a bow string release of superior accuracy.

It is an object of the invention to provide a bow string release utilizing pivoted string retainers and pivoted retainer operators wherein the bow string is released by a squeezing or pinching action of the fingers minimizing deviation of the release during triggering.

A further object of the invention is to provide a bow string release of concise configuration, easy to handle, and wherein superior accuracy is achieved during release by the application of uniform opposing forces to the release during triggering.

An additional important object of the invention is to provide a bow string release employing pivoted string retainers, pivoted retainer operators, and a toggle mechanism between the retainers and operators employing a three point pivot axis system wherein a near on-center relationship between the pivot axes is achieved during string retention maximizing the force produced to maintain the retainers in a string retaining condition, yet also minimizing the force required to trigger the release.

A further object of the invention is to provide a bow string release using pivoted string retainers wherein safety means are associated with the retainers preventing pivoting thereof to a string releasing position during the bow string draw.

A further object of the invention is to provide a bow string release used in conjunction with a wrist strap wherein the release body is pivotally mounted to the wrist strap and a swivel connection utilizes a built-in adjustment which is easily operable without tools for regulating the position of the release relative to the strap.

Another object of the invention is to provide a bow string release using a wrist strap in combination with rigid adjustable arms whereby the pivoting of the arms permits the wrist strap size to be adjusted once for a particular archer and the hand may be inserted through the wrist strap without further strap adjustment.

The bow string release consists of an elongated body which may be easily held within the archer's string drawing hand and the body is connected to a wrist strap by a swivel connection wherein the primary drawing forces transferred to the body are through the wrist strap minimizing the grasping force required on the body.

The body, basically, consists of upper and lower plates having a pair of string retainers pivotally mounted thereon each including a configured jaw portion defining a recess in which the bow string may be located during drawing. A pair of retainer operators in the form of levers are mounted upon the body between the plates and include handle portions laterally extending from opposite sides of the body wherein the operators may be simultaneously actuated by a pinching or squeezing action applied to the handle portions. The operators include lever portions connected to a toggle linkage located between the retainer operators and the retainers.

The toggle linkage includes three parallel pivots which are substantially aligned in the same plane during the closing of the retainers during the string drawing operation. The substantially on-center relationship of the center toggle pivot with respect to the end pivots permits high forces to be imposed upon the retainers by the bow string endeavoring to open the retainers without such opening occurring, and pivoting of the retainer operators displaces the center toggle pivot so as to permit the retainers to readily pivot to a string releasing position in a smooth non-deviating manner. The retainer operators may be pre-adjusted so that only a slight pivoting of the operators will permit the toggle linkage to release providing a "hair" trigger and optimum accuracy.

A safety device in the form of a spring biased finger operated button and stop is mounted upon the body selectively positionable adjacent the toggle linkage center pivot and the safety device prevents pivoting of the toggle linkage to a string releasing position, which significantly contributes to the safe operation of the release during string drawing.

As the position of the release body to the wrist strap is important from the standpoint of comfort and ease of operation a universal swivelable interconnection is interposed between the wrist strap and the release body utilizing an axially adjustable screw. The axial position of the screw is readily adjusted through a built-in hexagonal wrench system which is operable only when tension forces on the release body and wrist strap are relieved.

Optimum accuracy is considered to be achieved when the retainer operator handle portions are pinched or squeezed by the application of opposed forces to the handle portions by the fingers. However, some archers prefer a bow release to have a trigger wherein release can be achieved by pulling the trigger toward the archer. The release of the invention includes such a trigger selectively positionable between operative and inoperative positions on one of the retainer operators, and a spring biased detent maintains the trigger in the desired position.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
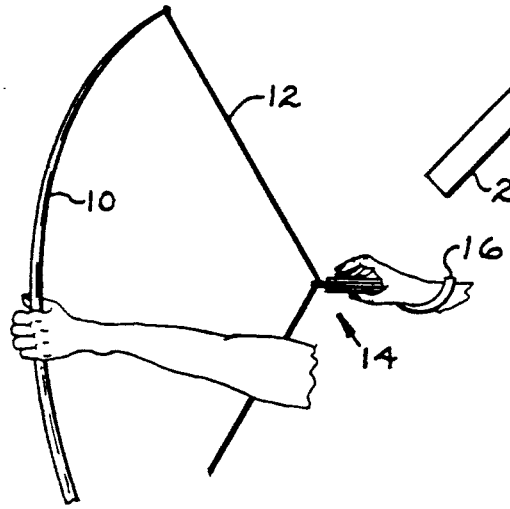
FIG. 1 is an elevational view of an archer holding a bow during string tensioning using the string release of the invention, the arrow being omitted for purpose of illustration.

FIG. 1 illustrates a typical manner for utilizing the bow string release of the invention. The archery bow is represented at 10 having a string 12. The right handed archer grasps the central handle region of the bow and with the right hand draws the string, and associated arrow, not shown, to the right. The release, generally indicated at 14, includes a wrist strap 16 circumscribing the archer's wrist, and the release body 18 will be located within the archer's hand and the forefinger will be depressing the safety device to hold the release in the safety position during the string draw, as later described.

Figure 2:
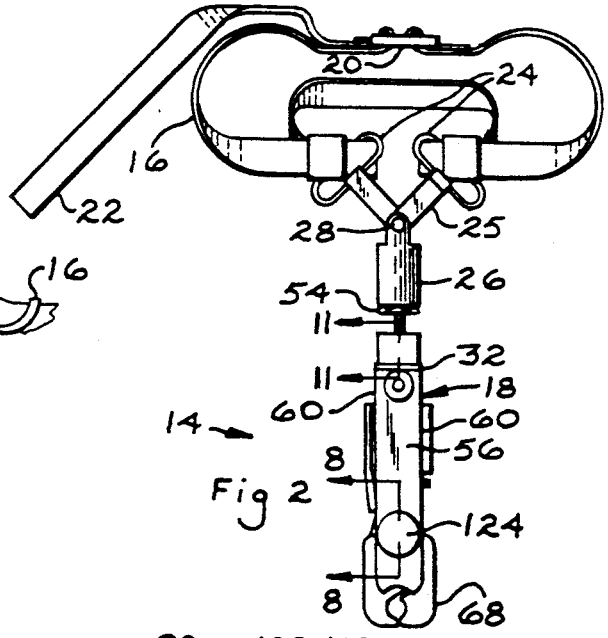
FIG. 2 is a plan view of the string release of the invention illustrating the wrist strap attached to the release body.

As best illustrated in FIG. 2, the wrist strap 16, which may be formed of a flexible woven web material, includes a buckle 20 wherein the dimension of the loop defined by the web may be readily adjusted by pulling upon the strap free end 22. In the usual manner, lifting of one side of the buckle 20 permits the loop size to be increased. The strap loop will be placed around the wrist of the archer as shown in FIG. 1, and fitted as desired.

A pair of elongated rings 24 are located on the strap each mounted upon a rigid arm 25 pivotally connected to the clevis 26 by pivot pin 28. In this manner, the arms 25 and associated rings are pivotally mounted to the clevis 26, and the clevis includes a threaded bore 30 for receiving the adjustment screw as described below. The rigid arms 25 aid in the comfort and fit of the strap assembly on the hand, and the pivoting of the arms keeps the wrist strap snug on the wrist during the string draw but permits the strap loop to receive the hand without further strap adjustment. Because of the pivoting of the arms 25 the strap loop dimension can be "opened" without actually operating the buckle 20 and as the tension is applied to the wrist strap the strap conforms to the hand configuration, the arms 25 pivot toward each other, and the loop of the wrist strap "closes" to a comfortable fit on the wrist capable of exerting the desired tension to the bow string.

The adjustment apparatus further includes a rear spacer 32 having a tongue 34 having a hole therethrough, and the spacer includes a threaded neck 36. Internally, the threaded neck includes a spherical recess having an axially extending hexagonal stud 40. A swivel cap 42 is threaded upon the spacer neck threads 36 and includes an elongated bore 44, FIG. 11, and a spherical seat 46, and the cap 42 is of sufficient axial dimension to permit movement of the spherical head 48 of screw 50 within the cap. The screw 50 threads into the clevis bore 30, and the spherical head 48 includes a hexagonal socket 52 corresponding in configuration to the stud 40 and adapted to receive the stud. A lock nut 54 is threaded upon the screw 50 and is adapted to engage the inner end of the clevis 26 to lock the adjustment of the screw within the clevis.

The basic components of the release body 18 are the elongated top plate 56 and the bottom plate 58. The plates 56 and 58 each include an inner end and an outer end, and parallel lateral edges 60 wherein the lateral sides of both plates are in superimposed alignment. At its inner end the top plate 56 is formed with a counter sunk hole 62, while the bottom plate inner end is provided with an aligned threaded hole 64. In this manner the screw 66 extends between the plate's inner ends through the hole in the rear spacer tongue 34 which is located between the plates and in this manner the spacer 32 is firmly affixed to the release body 18.

Figure 3:
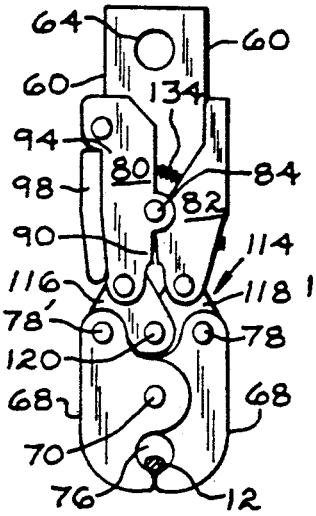
FIG. 3 is a plan view of the release body with the top plate removed for purpose of illustration, the string retainers and operators being shown in the string tensioning position.

A pair of identical bow string retainers or jaws 68 are pivotally mounted intermediate the plates 56 and 58 upon a pivot pin 70 extending into blind holes formed in the plates which also acts as a plate spacer. The retainers each include a jaw portion 72 each having a concave recess 74 defined therein which, together, form a string receiving chamber 76 as shown in FIG. 3 when the retainers are pivoted to their string retaining position of FIG. 3. Inwardly, the retainers 68 are each provided with a pivot pin 78 and 78' which is associated with the toggle linkage as later described. By using a single pivot 70 to pivotably support the retainers 68 the simultaneous and equal pivoting action of the retainers is assured and the use of the single pivot 70 produces a more uniform movement of both retainers than would be possible if each retainer had its own pivot pin.

Operation of the string retainers 68 is through the retainer operators 80 and 82 pivotally mounted between the plates 58 and 60 upon a pivot pin 84 which extends into blind elongated slots 86 found in each of the plates. The operator 82 includes a handle portion 88, an adjustable stop screw 90 threaded through the operator for engagement with operator 80, and a pivot pin 92 associated with the toggle linkage. The retainer operator 80 is also pivotally mounted upon the pivot pin 84 and includes a handle portion 94 and the toggle linkage pivot pin 96.

Figure 4:
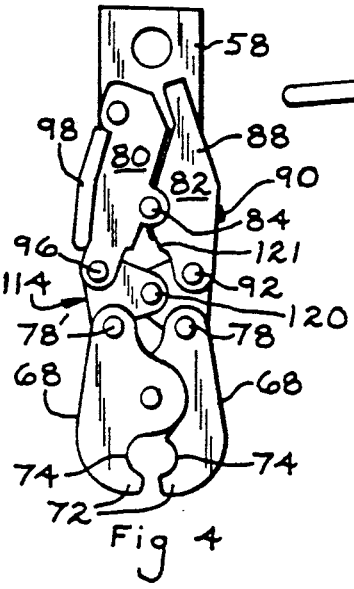
FIG. 4 is an illustration similar to FIG. 3 showing the string retainers and operators in the string release position.

The actuator operator 80 also includes a retractable and extendable trigger 98 pivotally mounted upon the handle portion 94 by pivot pin 100, and the trigger 98 is normally folded against the operator 80 and defines a lateral extension of the handle portion 94. However, upon pivoting the trigger 98 to the position shown in FIG. 7 the trigger extends well beyond the body lateral sides 60. Internally, the trigger 98 includes a hub 102 through which pin 100 extends and a pair of notches 104 and 106 defined are therein which cooperate with the ball detent 108 mounted within the bore 110 formed in operator 80. The compression spring 112 biases the ball detent to the left, FIG. 7, for selective engagement with the trigger notches 104 and 106, engaging the recess 104 when the trigger is extended as in FIG. 7, and engaging the notch 106 when the trigger is retracted as shown in FIGS. 3 and 4.

Figure 9:
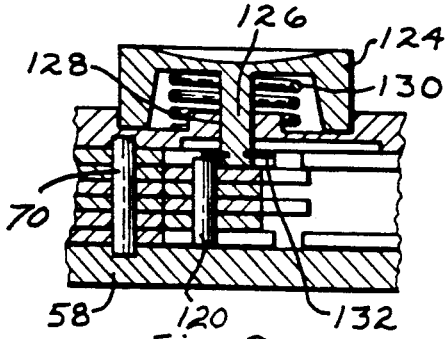
FIG. 9 is an elevational sectional view similar to FIG. 8 showing the safety apparatus in the "on" position.
Figure 6:
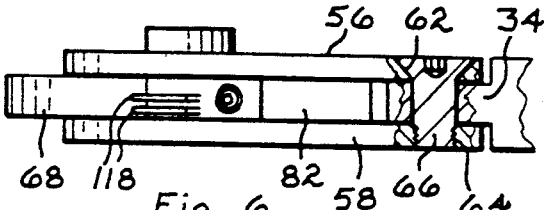
FIG. 6 is a side elevational view of the body as taken from the right of FIG. 2.
Figure 10:
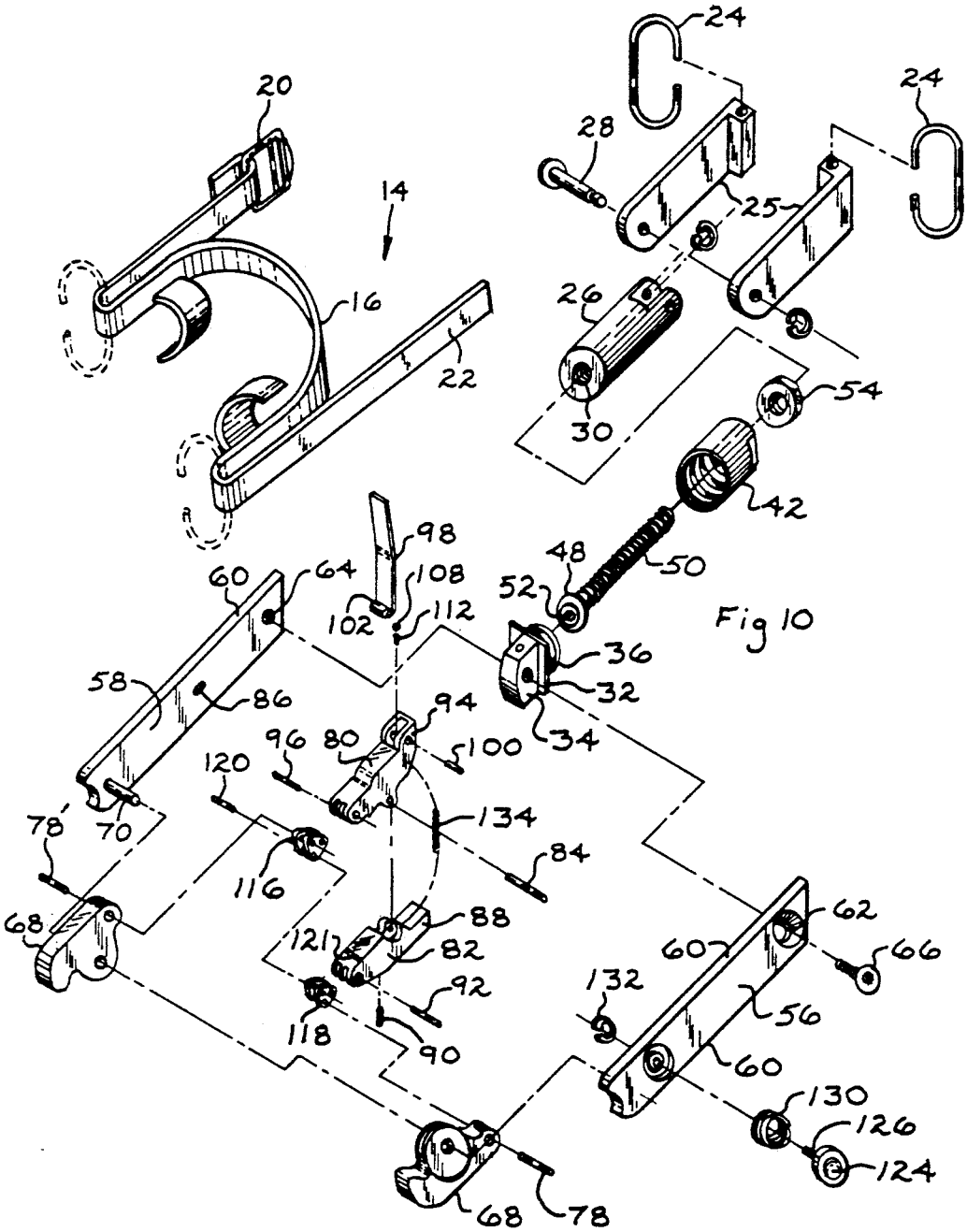
FIG. 10 is an exploded perspective view of the bow string release in accord with the invention.

The toggle linkage generally indicated at 114 consists of two sets of triangular plates 116 and 118, each set consisting of two spaced identical plates defining a link as will be appreciated from FIG. 10 and each having three holes. The plates of the toggle linkage are related to each other in a superimposed relationship, and the retainer pivot pins 78 extend through one of the link holes, the retainer operator pivot pins 92 and 96 extend through another link hole, and the center pivot pin 120 extends through the third hole defined in each of the links and extends above the linkage 114, as will be apparent from FIGS. 8 and 9.

As will be appreciated from the drawings, the operator handle portions 88 and 94 extend beyond the lateral edges 60 of the plates 56 and 58, and accordingly, the handle portions 94 and 88 are readily accessible to the archer wherein the thumb may be placed upon the handle portion 88, for instance, and the index finger upon the handle portion 94 and the retracted trigger 98. Squeezing or pinching the handle portions will pivot the retainer operators to the position shown in FIG. 4 separating the pivot pins 92 and 96 and causing the toggle linkage links to pivot about the pivot pins 92 and 96, and drawing the pivot pin 120 toward the pivot pin 84 and thereby opening the retainer chamber 76 as shown in FIG. 4 to release the bow string.

Safety apparatus for preventing premature opening of the bow string retainers 68 is mounted upon the top plate 56. The top plate is recessed as at 122, FIG. 8, and the button 124 is located within the recess having a stem 126 which extends through the base 128 defined in the top plate 56. A compression spring 130 biases the button upwardly, and the clip 132 located within a groove in the stem 126 prevents the spring from removing the stem from the bore 128.

Figure 8:
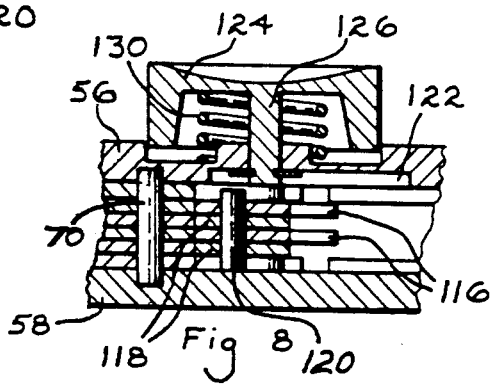
FIG. 8 is an enlarged detail sectional view through the safety apparatus as taken along section 8-8 of FIG. 2, the safety apparatus being shown in the "off" position.
Figure 5:
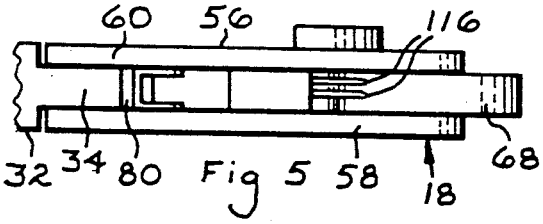
FIG. 5 is a side elevational view of the release body as taken from the left of FIG. 2.

The length of the stem 126 is such that when the spring 130 is biasing the button to its uppermost position as shown in FIG. 8, the end of the stem will be out of alignment with the upper end of the toggle linkage center pivot 120. However, when the button 124 is depressed to the condition shown in FIG. 9 the end of the stem 126 will extend below the upper end of the pivot 120, and as the stem is in direct rearward alignment with the pivot depressing of the button prevents the pivot 120 from moving in the rearward direction toward the pivot 84. Depressing of the button 124 and stem 126 to the position shown in FIG. 9 prevents the retainers 68 from pivoting from the string retaining position of FIG. 3 to the spring releasing position shown in FIG. 4.

Figure 11:
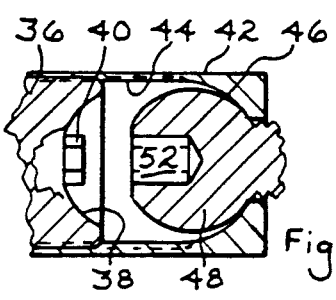
FIG. 11 is an enlarged detail sectional view through the swivel connection as taken along section 11—11 of FIG. 2 showing the swivel in the operative position.
Figure 12:
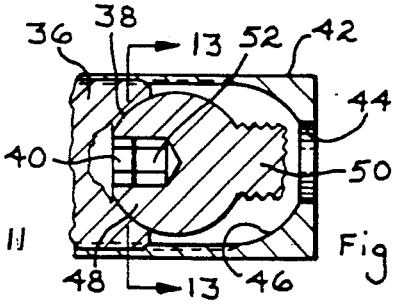
FIG. 12 is a sectional view similar to FIG. 11 illustrating the swivel connection components in the screw adjusting relationship.
Figure 13:
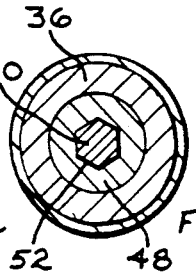
FIG. 13 is an elevational sectional view taken along section 13—13 of FIG. 12.

With reference to FIGS. 11-13, it will be appreciated that the universal ball and socket interconnection between the cap 42 and the head of screw 50 permits the body 18 to be readily adjustable relative to the clevis 26, and the use of this universally adjustable connection prevents binding or discomfort occurring which might arise due to misalignment of the wrist strap 16 to the body.

To permit adjustment of the distance of the body 18 from the wrist strap 16 and clevis 26 rotation of the screw 50 in the clevis bore 30 will adjust the spacing between the cap 42 and the clevis, and the lock nut 54 will maintain such pre-adjusted spacing.

To rotate the screw 50 relative to the clevis 26 the nut 54 must be backed off from engagement with the clevis, and the screw can be readily adjusted by grasping the body 18 and displacing the body and cap toward the clevis while the stud 40 and the hexagonal screw socket 52 are in alignment. In this manner the stud 40 will be received within the screw socket as shown in FIG. 12 and rotation of the body will rotate the screw and position the screw 50 within the clevis as desired. The lock nut 54 may then be tightened against the clevis 26 to maintain the adjustment. As the body 18 may be readily grasped and rotated the adjustment of the screw 50 can be accomplished without tools and the lock nut may be finger tightened, and may be very snugly positioned against the clevis by hand threading the nut against the clevis and then rotating the screw manually through the body 18 with the components in the relationship shown in FIG. 12.

Assembly of the body 18 is maintained by the screw 66. As the pivots 70 and 84 are each located within the plates 56 and 58 the tightening of the screw 66 prevents the separation of the plates and the single screw is sufficient to maintain the body components in the disclosed relationship.

In use, the archer places his string drawing hand through the wrist strap loop and adjusts the strap on the wrist by means of the strap end 22 if the strap loop size has not been previously adjusted. The release body 18 is held within the hand, and the retainer operator handle portions 88 and 94 are squeezed or pinched to open the retainers 68 to the position shown in FIG. 4. Thereupon, the bow string 12 may be located within the chamber 76, and the handle portions will be released and the compression spring 134 received within blind holes in operators 80 and 82 will bias the handle portions 88 and 94 away from each other so that the components are as shown in FIG. 3. As the archer draws his arm back the forefinger is placed upon the safety button 124 depressing the button to the position shown in FIG. 9 preventing displacement of the toggle linkage pivot 120 toward the pivot 84 assuring that the bow string 12 will be retained within the chamber 76 during bow tensioning. Upon the bow string being fully drawn the archer will remove the forefinger from the button 124 and place the forefinger adjacent the handle portion 94.

When the archer desires to release the bow string and arrow the thumb is placed upon the handle portion 88, and the forefinger upon the handle portion 94 and retracted trigger 98. Squeezing of the fingers displaces the retainer operator handle portions toward each other pivoting the operators 80 and 82 from the position as shown in FIG. 3, drawing the center toggle pivot 120 toward the pivot 84, and opening the retainers 68 to the position shown in FIG. 4 releasing the string and arrow. Pivoting of the linkage plates 116 and 118 to the release position is terminated by the plates engaging shoulders 121 formed on the operators 80 and 82. As the forces exerted upon the body 18 to release the bow string are the opposing pinching or squeezing forces applied to the handle portions 88 and 94 a steady force may be applied in such opposite directions so as not to displace or deviate the body from its desired location, and optimum accuracy is achieved.

Figure 7:
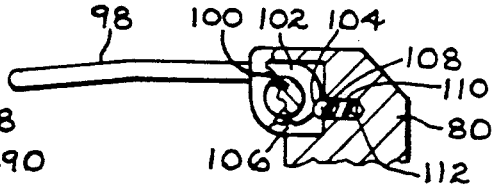
FIG. 7 is a plan, enlarged, partially sectioned view of the trigger shown in the extended position.

If the archer desires to extend the trigger 98 so that operation of the operators 80 and 82, and release of the bow string, is accomplished by a rearward force on the trigger the trigger will be extended to the position shown in FIG. 7, and the index finger may be used to pull the trigger rearwardly which will pivot the operators to the position shown in FIG. 4 and release the bow string.

As will be appreciated from FIG. 3, when the retainers 68 are in the string retaining position a plane extending through and continuing the axes of the "end" pivots 78 and 78' also substantially contains the axis of toggle center pivot 120. Movement of the axis of pivot 120 through such plane will produce an "over-center" relationship, which would aid in preventing opening of the retainers due to the forces imposed thereon by the bow string during the draw. However, in actuality, it is not necessary for the axis of pivot pin 120 to pass through the plane in which the pivots 78 and 78' lie, and the axis of the pivot 120 may actually be slightly "short" of such plane, i.e. an "on center" relationship when the components are adjusted for optimum operation. The force provided by the compression spring 134 located within recesses in the operators 80 and 82 bias the operators toward the retainer closed position of FIG. 3 and the presence of this spring plus frictional forces eliminates the need for the pivot pin 120 to extend beyond "center" to counteract the opening forces applied to retainer 68 by the bow string forces. As the end of the stop screw 90 engages the operator 80 the position of the retainer operators and the pivot pin 120 can be very accurately controlled to determine the position of the retainers 68 during string confinement and prior to release, and by adjusting the screw 90 the amount of force required to release the bow string can be very finely regulated and the sensitivity of the apparatus adjusted so that a "hair trigger" release can be obtained.

By using slots 86 in plates 56 and 58 to support pivot pin 84 no binding occurs during the operation of the retainers 68 and operators 80 and 82. The slots 86 permit about 0.010" movement of the pin 84 in the body longitudinal direction and this movement of the pivot pin prevents binding as the pivot pins 92 and 96 travel through their arcs during toggle linkage operation.

It will be appreciated that various modifications to the various concepts may be apparent to those skilled in the art without departing from the spirit and scope of the invention.

I claim:

1. A bow string release comprising, in combination, an elongated body having a first end, a second end, a central region intermediate said ends, opposite lateral edges and opposite sides, a pair of bow string retainers movably mounted on said body between string retaining and string releasing positions, a pair of retainer operators movably mounted upon said body each having a manually engageable handle portion defined thereon and movable between first and second positions, said handle portions each extending from a body lateral edge, and linkage means interposed between said retainers and said retainer operators whereby manually moving said retainer operators handle portions toward each other from said first position to said second position moves said bow string retainers from said string retaining position to said string releasing position.

2. In a bow string release as in claim 1, spring means biasing said retainer operators toward said first position.

3. In a bow string release as in claim 1, first pivot means pivotally mounting said bow string retainers on said body, and second pivot means pivotally mounting said retainer operators on said body.

4. In a bow string release as in claim 3, said linkage means including first and second linkages pivotally connected to said retainer operators, respectively, and each pivotally connected to said bow string retainers at first and second pivot axes, a third pivot axis interconnecting said first and second linkages, said first, second and third axes being substantially parallel, stop means limiting pivoting of said bow string retainers toward said string retaining position, said third pivot axis approaching the plane extending between and including said first and second pivot axes when said retainers are located in said string retaining position.

5. In a bow string release as in claim 4, safety means mounted on said body selectively locking said third pivot in said approaching on-center relationship.

6. In a bow string release as in claim 1, safety means mounted on said body selectively locking said bow string retainers in said string retaining position.

7. In a bow string release as in claim 1, said linkage means comprising a toggle linkage.

8. In a bow string release as in claim 1, a handle extension pivotally mounted upon said handle portion of at least one of said retainer operators pivotal between extended and retracted positions.

9. In a bow string release as in claim 8, spring biased detent means mounted on said one retainer operator frictionally releasably maintaining said handle extension in said extended and retracted positions.

10. A bow string release comprising, in combination, an elongated body having a first end, a second end, a central region intermediate said ends, opposite lateral edges and opposite sides, a pair of bow string retainers mounted on said body for pivotal movement about a first axis between string retaining and string releasing positions, a pair of retainer operators pivotally mounted upon said body, a handle portion defined on at least one of said retainer operators, and a toggle linkage interconnecting said retainer operators and said retainers, said toggle linkage including three pivot axes whereby pivoting of said operators by said handle portion pivots said retainers between said string retaining and said string releasing positions, said three toggle linkage axes being substantially linearly aligned in said string retaining position.

11. In a bow string release as in claim 10, said toggle linkage including first and second lateral pivot axes and a third pivot axis intermediate said lateral pivot axes, said pivot axes being substantially parallel, said third pivot axis approaching the plane in which said first and second axes lie upon said retainers pivoting between said string releasing and retaining positions whereby a substantially planar aligned relationship between said first and second pivot axes and said third axis exists when said retainers are in said string retaining position, and stop means defined on said body limiting movement of said retainers toward said string retaining position.

12. In a bow string release as in claim 11, safety means movably mounted on said body selectively movable between interfering and non-interfering positions relative to said third pivot axis to lock said bow string retainers in said string retaining position.

13. In a bow string release as in claim 10, safety means movably mounted on said body selectively locking said bow string retainers in said string retaining position.

* * * * *